US012123066B2

(12) United States Patent
Lee et al.

(10) Patent No.: US 12,123,066 B2
(45) Date of Patent: Oct. 22, 2024

(54) ULTRAHIGH-STRENGTH STEEL SHEET HAVING EXCELLENT YIELD RATIO, AND MANUFACTURING METHOD THEREFOR

(71) Applicants: POSCO CO., LTD, Pohang-si (KR); POSTECH ACADEMY-INDUSTRY FOUNDATION, Pohang-si (KR)

(72) Inventors: Sea-Woong Lee, Gwangyang-si (KR); Bruno C. De Cooman, Pohang-si (KR); Kyoo-Young Lee, Gwangyang-si (KR); Eun-Jung Seo, Pohang-si (KR); Seon-Jong Lee, Gwangyang-si (KR); Joo-Hyun Ryu, Gwangyang-si (KR); Won-Hwi Lee, Gwangyang-si (KR)

(73) Assignees: POSCO CO. LTD, Pohang-si (KR); POSTECH ACADEMY-INDUSTRY FOUNDATION, Pohang-si (KR)

( * ) Notice: Subject to any disclaimer, the term of this patent is extended or adjusted under 35 U.S.C. 154(b) by 333 days.

(21) Appl. No.: 16/347,704

(22) PCT Filed: Nov. 7, 2017

(86) PCT No.: PCT/KR2017/012533
§ 371 (c)(1),
(2) Date: May 6, 2019

(87) PCT Pub. No.: WO2018/084685
PCT Pub. Date: May 11, 2018

(65) Prior Publication Data

US 2019/0256940 A1 Aug. 22, 2019

(30) Foreign Application Priority Data

Nov. 7, 2016 (KR) ..... 10-2016-0147411

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 6/002; C21D 6/005; C21D 6/008; C21D 8/0205; C21D 8/0226;
(Continued)

(56) References Cited

U.S. PATENT DOCUMENTS 6,190,469 B1 2/2001 Koh et al.
2003/0047259 A1 3/2003 Sakata et al.
(Continued)

FOREIGN PATENT DOCUMENTS

CN 1207143 A 2/1999
CN 103392022 A 11/2013
(Continued)

OTHER PUBLICATIONS

International Search Report dated Feb. 8, 2018 issued in corresponding International Patent Application No. PCT/KR2017/012533.
(Continued)

*Primary Examiner* — Adil A. Siddiqui
(74) *Attorney, Agent, or Firm* — Morgan, Lewis & Bockius LLP

(57) ABSTRACT

One aspect of the present invention relates to an ultrahigh-strength steel sheet having an excellent yield ratio, comprising, by wt %, 0.3-0.5% of C, 2.0% (excluding 0%) of Si,
(Continued)

3.0-6.5% of Mn, 0.02% or less of P, 0.01% or less of S, 0.01-3.0% of Al, 0.02% or less (excluding 0%) of N, and the balance of Fe and other inevitable impurities, and a microstructure comprises 5-30% of remaining austenite by area fraction and comprises 5% or less of secondary martensite.

7 Claims, 2 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/38*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.
CPC ..... *C21D 8/0205* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/38* (2013.01); *C23C 2/0224* (2022.08); *C23C 2/06* (2013.01); *C23C 2/28* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC .. C21D 8/0236; C21D 8/0263; C21D 8/0278; C21D 2211/001; C21D 2211/002; C21D 2211/005; C21D 2211/008; C22C 38/001; C22C 38/002; C22C 38/02; C22C 38/04; C22C 38/06; C22C 38/12; C22C 38/38; C22C 38/26; C23C 2/02; C23C 2/06; C23C 2/40; C23C 2/28
See application file for complete search history.

(56) References Cited

U.S. PATENT DOCUMENTS

| | | | | |
|---|---|---|---|---|
| 2006/0011274 | A1 | 1/2006 | Speer et al. | |
| 2011/0048589 | A1 | 3/2011 | Matsuda et al. | |
| 2011/0139317 | A1 | 6/2011 | Taniguchi et al. | |
| 2011/0146852 | A1 | 6/2011 | Matsuda et al. | |
| 2011/0198002 | A1 | 8/2011 | Nakagaito et al. | |
| 2013/0295402 | A1 | 11/2013 | Oh et al. | |
| 2014/0227546 | A1* | 8/2014 | Mesplont | C21D 8/06 148/333 |
| 2014/0322559 | A1 | 10/2014 | Becker et al. | |
| 2014/0377584 | A1 | 12/2014 | Hasegawa et al. | |
| 2015/0086808 | A1 | 3/2015 | Kasuya et al. | |
| 2015/0203947 | A1 | 7/2015 | Hasegawa et al. | |
| 2016/0047011 | A1 | 2/2016 | Kawabe et al. | |
| 2019/0218652 | A1* | 7/2019 | Haga | C21D 8/0442 |
| 2021/0262069 | A1* | 8/2021 | Irnich | C22C 38/22 |

FOREIGN PATENT DOCUMENTS

| | | | |
|---|---|---|---|
| EP | 1676933 | A1 | 7/2006 |
| EP | 2778247 | A1 | 9/2014 |
| JP | H02-175839 | A | 7/1990 |
| JP | H07-188834 | A | 7/1995 |
| JP | 2001-303185 | A | 10/2001 |
| JP | 2002-302734 | A | 10/2002 |
| JP | 2005-200694 | A | 7/2005 |
| JP | 2008-127581 | A | 6/2008 |
| JP | 2009-203549 | A | 9/2009 |
| JP | 2009-209450 | A | 9/2009 |
| JP | 2012-031462 | A | 2/2012 |
| JP | 2012-237044 | A | 12/2012 |
| JP | 2014-508854 | A | 4/2014 |
| JP | 2015-193891 | A | 11/2015 |
| JP | 2017-145469 | A | 8/2017 |
| JP | 2017-524817 | A | 8/2017 |
| KR | 10-0685040 | A | 2/2007 |
| KR | 10-2010-0099757 | A | 9/2010 |
| KR | 10-2011-0039395 | A | 4/2011 |
| KR | 10-2014-0011498 | A | 1/2014 |
| KR | 10-2014-0024903 | A | 3/2014 |
| KR | 10-2014-0129316 | A | 11/2014 |
| KR | 10-2015-0029736 | A | 3/2015 |
| KR | 10-2015-0123903 | A | 11/2015 |
| WO | 2016/001705 | A1 | 1/2016 |
| WO | 2016/001892 | A2 | 1/2016 |
| WO | 2016/136625 | A1 | 9/2016 |

OTHER PUBLICATIONS

Extended European Search Report dated Oct. 22, 2019 issued in European Patent Application No. 17866822.4.
Japanese Office Action dated Jun. 9, 2020 issued in Japanese Patent Application No. 2019-522491.
Chinese Office Action dated Jul. 28, 2020 issued in Chinese Patent Application No. 201780068840.3.

* cited by examiner

【FIG. 1】
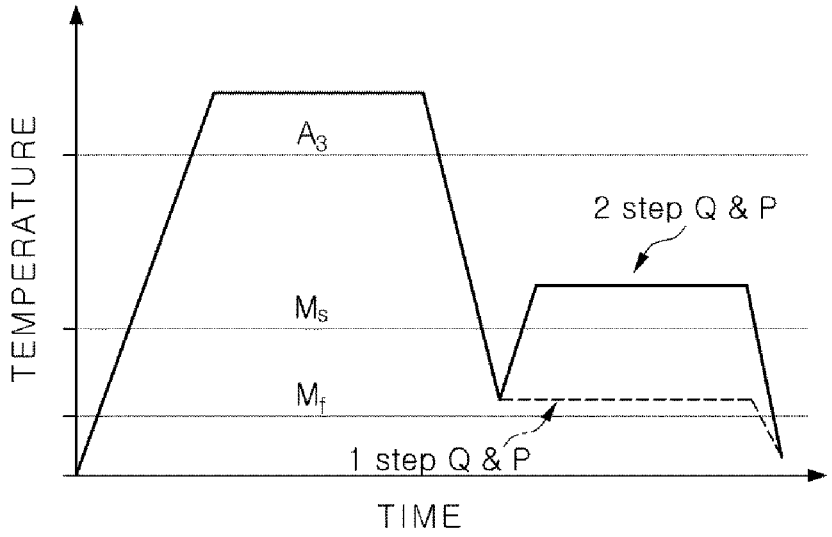

【FIG. 2】
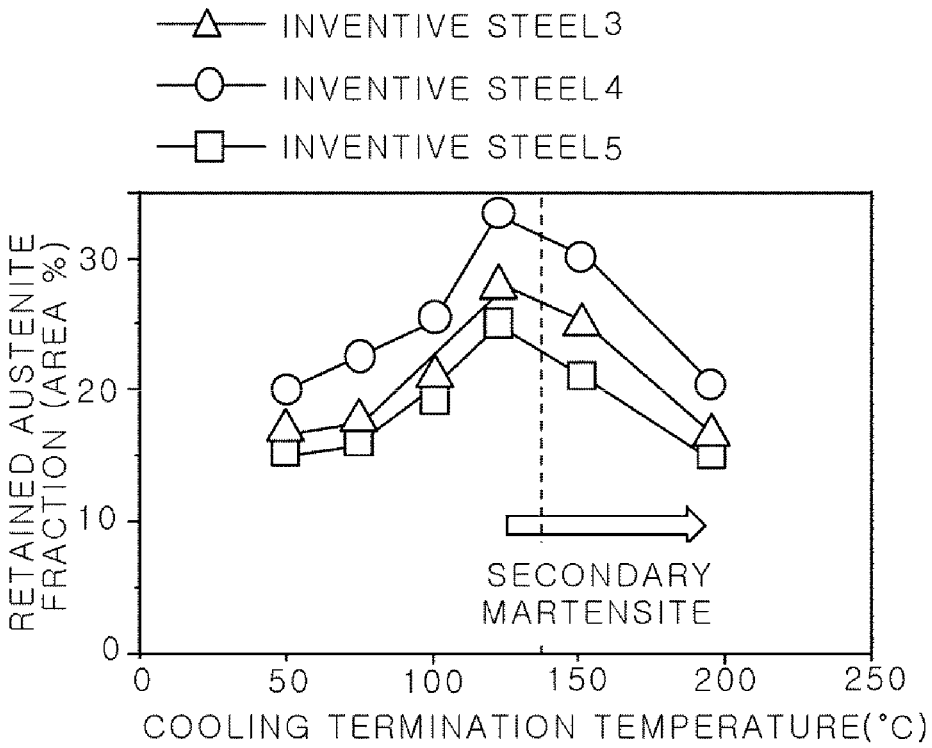

ULTRAHIGH-STRENGTH STEEL SHEET HAVING EXCELLENT YIELD RATIO, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/012533, filed on Nov. 7, 2017, which in turn claims the benefit of Korean Patent Application No. 10-2016-0147411, filed Nov. 7, 2016, the entire disclosures of which applications are incorporated by reference herein.

TECHNICAL FIELD

The present disclosure relates to an ultra high-strength steel sheet having an excellent yield ratio and a manufacturing method therefor.

BACKGROUND ART

In order to regulate $CO_2$ emissions from automobiles, which are being enforced, and to improve fuel efficiency, automakers are constantly demanding lightweight bodies. In order to reduce a weight of automotive steel sheet, the thickness of the steel sheet must be lowered. On the other hand, there may be an inconsistent aspect in that the thickness of the steel sheet must be increased to secure collision safety.

In order to solve the above-described inconsistent aspect, it is necessary to increase formability while increasing the strength of the material, and this has been known to be possible through various automotive steel sheets such as dual phase steel (hereinafter, referred to as DP steel), known as advanced high strength steel (AHSS), transformation induced plasticity steel (hereinafter, referred to as TRIP steel), complex phase steel (hereinafter, referred to as CP steel), and the like. It is possible to further increase the strength of advanced strength of an advance high strength steel by increasing an amount of carbon or an alloy component, but tensile strength which may be implemented is limited to a level of about 1200 MPa when considering practical aspects such as spot weldability, or the like.

As another method, there is a quenching & partitioning (Q & P)method in which hot-temperature austenite may be rapidly quenched at a temperature between a martensite transformation post temperature $M_s$ and a transformation completion temperature $M_f$ during a heat treatment process to secure low-temperature martensite and at the same time, and which may secure strength and elongation at the same time, by diffusing austenite stabilizing elements such as C, Mn, or the like, into a remaining austenite phase at an appropriate temperature. As illustrated in FIG. 1, a heat treatment process in which steel is heated to a temperature of $A_3$ or higher and quenched to a temperature of $M_s$ or lower to be maintained between $M_s$ and $M_f$ temperatures may be referred to as a 1step Q & P, and a process of reheating the steel after quenching to a temperature of $M_s$ or higher to perform a heat treatment may be referred to as a 2step Q & P.

For example, Patent Document 1 describes a method of retaining austenite by the Q & P heat treatment. However, a concept of Q & P heat treatment is simply explained, such that there is a limit to practical application.

Meanwhile, as a component applicable to a structural member for ensuring collision safety, a hot press forming steel ensuring final strength by quenching by direct contact with a die water-cooling after forming at a high temperature may be in the spotlight. However, there has been a problem of excessive facility investment costs, and an increase in heat treatment and process costs, such that the development of a material capable of cold press forming, which is more inexpensive, is required.

Meanwhile, high yield strength and tensile strength may be required for substitution of hot press forming components. An inventive steel in Patent Document 2 may have high hole expandability, such that cold press forming may be possible, but a yield ratio is lower, less than 0.7, and is low in tensile strength of 1000 MPa, which is not suitable as a substitute for hot press forming.

Therefore, there is a demand for development of an ultrahigh-strength steel sheet having an excellent yield ratio and a manufacturing method therefor.

Prior Art Document (Patent Document 1) United States Patent Laid-Open Publication No. 2006-0011274

(Patent Document 2) Korean Patent Laid-Open Publication No. 2015-0123903

DISCLOSURE

Technical Problem

An aspect of the present disclosure is to provide an ultrahigh-strength steel sheet having an excellent yield ratio and a manufacturing method therefor.

Meanwhile, an aspect of the present disclosure is not limited to the above description. A subject of the present disclosure may be understood from an overall content of the present specification, and it will be understood by those skilled in the art that there is no difficulty in understanding additional subjects of the present disclosure.

Technical Solution

According to an aspect of the present disclosure, an ultrahigh-strength steel sheet having an excellent yield ratio may include: 0.3 to 0.35 wt % of C, 2.0 wt % of Si (excluding 0%), 3.0 to 6.5 wt % of Mn, 0.02 wt % or less of P, 0.01 wt % or less of S, 0.01 to 3.0 wt % of Al, 0.02 wt % or less of N (excluding 0%), a remainder of Fe and other unavoidable impurities, wherein a microstructure may include 5 to 30% of retained austenite by area fraction and may include 5% or less of secondary martensite by area fraction.

In addition, according to another aspect of the present disclosure, a manufacturing method of an ultrahigh-strength steel sheet having an excellent yield ratio may include steps of: heating a steel slab including 0.3 to 0.5 wt % of C, 2,0 wt % or less of Si (excluding 0%), 3.0 to 6.5 wt % of Mn, 0.02 wt % or less of P, 0.01 wt % or less of S, 0.01 to 3.0 wt % of Al, 0.02 wt % or less of N (excluding 0%), a remainder of Fe and other unavoidable impurities to 1000 to 1250° C.; performing hot-rolling the heated steel slab such that a temperature on a finish rolling exit side is 500 to 950° C. to obtain a hot-rolled steel sheet; winding the hot-rolled steel sheet at a temperature of 750° C. or lower; performing cold-rolling the wound hot-rolled steel sheet at a reduction ratio of 30 to 80% to obtain a cold-rolled steel sheet; annealing the cold-rolled steel sheet in a temperature range of 750 to 950° C.; cooling the annealed cold-rolled steel sheet to a cooling termination temperature of Mf to Ms−90° C.; and heat treating the cooled cold-rolled steel sheet at a temperature of Ms+100° C. or higher for 250 seconds or longer.

Further, a solution of the above-mentioned problems does not list all of the features of the present disclosure. The various features and advantages and effects of the present disclosure can be understood in more detail with reference to the following specific embodiments.

Advantageous Effects

According to the present disclosure, an ultrahigh-strength steel sheet having an excellent yield ratio and a manufacturing method therefor may be provided. More specifically, it is possible to secure a high yield strength and a tensile strength after forming, thereby substituting hot press forming parts. Accordingly, it is possible to substitute expensive hot press forming parts for cold press forming parts having a low cost, and to suppress $CO_2$ generation caused by high temperature to contribute to preservation of the global environment as an eco-friendly material compared to hot press forming steel.

DESCRIPTION OF DRAWINGS

FIG. 1 is a time-temperature graph for 1 step Q & P and 2 step Q & P.

FIG. 2 is a graph of retained austenite fraction according to a cooling termination temperature.

BEST MODE FOR INVENTION

Hereinafter, exemplary embodiments of the present disclosure will be described in detail with reference to the accompanying drawings. The disclosure may, however, be exemplified in many different forms and should not be construed as being limited to the specific embodiments set forth herein, and those skilled in the art and understanding the present disclosure can easily accomplish retrogressive inventions or other embodiments included in the scope of the present disclosure.

The present inventors have conducted intensive research to develop a steel sheet suitable for cold press forming, capable of replacing an existing hot press forming steel with cold press forming steel sheet, having mechanical properties equal to or higher than the existing steel sheet, and reducing manufacturing costs. As a result, it has been found that an ultra high-strength and high-ductility steel sheet having excellent mechanical properties and microstructure and excellent yield strength suitable for cold press forming may be provided by optimizing component compositions and manufacturing conditions of steel, thereby completing the present disclosure.

Ultrahigh-Strength Steel Sheet Ravine Excellent Yield Ratio

Hereinafter, an ultrahigh-strength steel sheet having an excellent yield ratio according to an aspect of the present disclosure will be described in detail.

An ultrahigh-strength steel sheet having an excellent yield ratio according to an aspect of the present disclosure may include: 0.3 to 0.5 wt % of C, 2% or less of Si (excluding 0%), 3.0 to 6.5 wt % of Mn, 0.02 wt % or less of P, 0.01 wt % or less of S, 0.01 to 3.0 wt % of Al, 0.02 wt % or less of N (excluding 0%), a remainder of Fe and other unavoidable impurities, and a microstructure may include 5 to 30% of retained austenite by area fraction, and 5% or less of secondary martensite by area fraction.

First, an alloy composition of an ultrahigh-strength steel sheet having an excellent yield ratio according to an aspect of the present disclosure will be described in detail. Hereinafter, a unit of each element content may be % by weight.

C: 0.3% to 0.5%

Carbon (C) may be an element contributing to stabilization of remaining austenite.

When a content of C is less than 0.3%, it is difficult to sufficiently secure the stability of austenite during the final heat treatment. Therefore, a lower limit of the content of C is preferably 0.3%, more preferably may be 0.35%, and still more preferably may be 0.4% in order to easily secure the strength and austenite stability.

On the other hand, when the content of C exceeds 0.5%, there is a problem that not only a risk of occurrence of defects in a slab increases, but also the weldability is greatly deteriorated. Therefore, an upper limit of the content of C may be preferably 0.5%, more preferably may be 0.48%, and still more preferably may be 0.45%.

Si: 2.0% or less (excluding 0%)

Silicon (Si) may be an element suppressing precipitation of carbide and may be an element contributing to stabilization of retained austenite. However, when a content of Si exceeds 2.0%, there is a problem that a ferrite phase exists even at a high temperature of 900° C. or higher, and thus a single phase of austenite may not be secured at a high temperature. Therefore, the content of Si may be preferably be 2.0% or less (excluding 0%), more preferably be 1.8% or less, still more preferably be 1.5% or less.

Mn: 3.0 to 6.5%

Manganese (Mn) may be an element contributing to formation and stabilization of retained austenite. Mn may be known as an element widely used in a transformational organic plasticity steel. Mn may be usually added within 3.0% in the case of TRIP steel, and may be usually added in an amount of 18.0% or more in the case of TWIP steel, which is austenite single phase steel.

When a content of Mn is less than 3.0%, there is a problem that it is difficult to secure retained austenite at a room temperature after the heat treatment, and a large amount of phases such as ferrite, bainite, and the like may be contained during quenching after annealing. Therefore, a lower limit of the content of Mn may be preferably 3.0%, more preferably be 3.5%, and still more preferably be 4.0% in order to more easily secure retained austenite.

On the other hand, when the content of Mn exceeds 6.5%, there is a problem that a production cost may be increased, and rolling load during hot rolling may be increased, such that operability may be deteriorated. Therefore, an upper limit of the content of Mn may be preferably 6.5%, more preferably be 6.4%, and still more preferably be 6.3%.

P: 0.02% or less

Phosphorus (P) may be an impurity element, when a content thereof exceeds 0.02%, the weldability may be lowered and the risk of low temperature embrittlement of the steel may be greatly increased. Therefore, a content of P may be preferably 0.02% or less.

S: 0.01% or less

S may be an impurity element, when a content thereof exceeds 0.01%, there is a high possibility of deteriorating ductility and weldability of the steel sheet.

Al: 0.01 to 3.0%

Aluminum (Al) may be an element which is combined with oxygen to deoxidize it, and it is preferable that a content of Al is maintained at 0.01% or more to obtain a stable deoxidation effect. However, Al may be a representative ferrite region expansion element at a high temperature together with Si. When a content of Al exceeds 3.0%, a ferrite phase may coexist with an austenite phase even at a high temperature of 900° C. or higher, and thus an austenite single phase region, which is important in the heat treatment process may be absent. Therefore, the content of Al may be preferably be 0.01 to 3.0%, more preferably be 0.02 to 2.5%.

Nitrogen (N): 0.02% or less (excluding 0%)

N may be an effective component for stabilizing austenite, however, when a content of N exceeds 0.02%, a risk of brittleness may be greatly increased, such that the content thereof may be limited 0.02% or less.

In the present disclosure, since austenite is sufficiently stabilized by other alloying elements, the lower limited thereof is not particularly limited. However, it may inevitably be included, according to the manufacturing process.

The remainder of the present disclosure is iron (Fe). However, in an ordinary manufacturing process, impurities which are not intended may be inevitably included from a raw material or the surrounding environment, such that they may not be excluded. Since impurities are known to any person skilled in the art of the ordinary manufacturing process, all of the details are not specifically mentioned in this specification.

By satisfying the alloy composition described above, a desired effect of the present disclosure may be obtained. However, the steel sheet may further include at least one or more of 1.5 wt % or less of Cr (excluding 0%), 0.005 to 0.5 wt % of Ti, 0.005 to 0.5 wt % of Nb, 0.005 to 0.5 wt % of V, and 0.05 to 0.3 wt % of Mo.

The Cr may be known as an element capable of suppressing growth of ferrite and increasing hardenability of a material. However, when a content of Cr exceeds 1.5%, formation of carbides may be caused such that the stability of the retained austenite may be deteriorated. Therefore, the content of Cr may be preferably 1.5% or less (excluding 0%).

The Ti, Nb, and V may be elements for increasing strength and the grain size of the steel sheet. When the content of each of the Ti, Nb, and V is less than 0.005%, it may be difficult to sufficiently secure such effect, and when the content of each of the Ti, Nb, and V exceeds 0.5%, the ductility may be greatly deteriorated due to an increase in production costs and excessive precipitates. Therefore, the content of each of the Ti, Nb, and V may be preferably 0.005 to 0.50%.

The Mo may be an element enhancing hardenability and suppressing formation of ferrite, and may suppress the formation of ferrite when cooling after annealing. In addition, the Mo may be an element contributing to the increase in strength through formation of fine carbides. When a content of Mo is less than 0.05%, it is difficult to sufficiently secure such effect, and when the content of Mo excesses 0.3%, a ferroalloy cost may be increased due to excessive alloying input. Therefore, the content of Mo may preferably be 0.05 to 0.3%.

Hereinafter, a microstructure of a steel sheet according to an aspect of the present disclosure will be described in detail.

According to an aspect of the present disclosure, a microstructure of the steel sheet may include 5 to 30% of remaining austenite by area fraction and 5% or less of secondary martensite by area fraction.

In order to increase the strength of the steel sheet, it is important to have a martensite phase having a high dislocation density. However, due to the high dislocation density, the martensite phase has limited elongation. By retaining austenite of 5% or more by area fraction, it is possible to secure elongation by increasing work hardening through the formation of transformed martensite at the time of transformation. However, when the retained austenite exceeds 30% by area fraction, the stability of the austenite may be reduced and the yield ratio (YR) may be 0.7 or less. Therefore, the retaining austenite may be preferably 30% or less by area fraction.

In addition, even when the retained austenite does not exceed 30% by area fraction, when the secondary martensite is contained in excess of 5% by area fraction to deteriorate the stability of the austenite at the time of final cooling, an amount of mobile dislocation in the steel may be increased and the yield strength may be reduced, such that the yield ratio (YR) may be 0.70 or less. Therefore, it is preferable to control the secondary martensite to be 5% or less by area fraction, and it is more preferable to control the secondary martensite to be 0% by area fraction.

In this case, the microstructure other than the remaining austenite and the secondary martensite may include ferrite, bainite, and fresh martensite.

In addition, a sum of the ferrite and bainite may be 20% or less by area fraction.

When the sum of the ferrite and bainite exceeds 20% by area fraction, the yield strength may be deteriorated.

Meanwhile, the steel sheet according to an aspect of the present disclosure may have excellent properties having a yield strength of 1000 MPa or more, a tensile strength of 1300 MPa or more, and a yield ratio of 0.7 or more. By securing such high strengths and high yield ratio, it is possible to replace expensive hot press forming components with low cost cold press forming components, and to suppress the $CO_2$ generation caused by high temperature formation.

In addition, the steel sheet may have a hot-dip galvanizing layer or an alloyed hot-dip galvanizing layer formed on the surface of the steel sheet.

Manufacturing Method of an Ultrahigh-Strength Steel Sheet Having an Excellent Yield Ratio Hereinafter, a manufacturing method of an ultrahigh-strength steel sheet having an excellent yield ratio according to another aspect of the present disclosure will be described in detail.

According to another aspect of the present disclosure, a manufacturing method of an ultrahigh-strength steel sheet having an excellent yield ratio may include steps of:

heating a steel slab satisfying the above-described alloy composition to 1000 to 1250° C.; performing hot-rolling the heated steel slab such that a temperature on a finish rolling exit side is 500 to 950° C. to obtain a hot-rolled steel sheet; winding the hot-rolled steel sheet at a temperature of 750° C. or lower; performing cold-rolling the wound hot-rolled steel sheet at a reduction ratio of 30 to 80% to obtain a cold-rolled steel sheet; annealing the cold-rolled steel sheet in a temperature range of 750 to 950° C.; cooling the annealed cold-rolled steel sheet to a cooling termination temperature of Mf to Ms−90° C.; and heat treating the cooled cold-rolled steel sheet for 250 seconds or longer at a temperature of Ms+100° C. or higher.

Slab Heating Step

The steel slab satisfying the above-described alloy composition may be heated to 1000 to 1250° C. This is because, when a heating temperature of the steel slab is less than 1000° C., rolling load may be sharply increased, and when the heating temperature of the steel slab exceeds 1250° C., not only an energy cost may be increased, but also a surface scale amount may be greatly increased.

Hot Rolling and Winding Step

The heated steel slab may be hot-rolled such that a temperature on a finish rolling exit side is 500 to 950° C., to obtain a hot-rolled steel sheet, and then wound at a temperature of 750° C. or lower.

When the temperature at the finish rolling exit side is less than 500° C., rolling load may be greatly increased and rolling itself may become difficult, and when the temperature thereof exceeds 950° C., a thermal fatigue of a rolling roll may be greatly increased, which may be a cause of shortening a life span.

In addition, when a coiling temperature is too high, which exceeds 750° C., it may be a cause of scale defects.

In this case, it may further include a step of heat treating the hot-rolled steel sheet wound before cool rolling after the step of the wounding at a temperature of 800° C. or lower for 30 minutes or longer. This is because, when the strength of the wound hot-rolled steel sheet is large, a cold rolling load may be increased, which may hinder cold rolling workability or cause a difficulty in increasing a cold rolling width.

Cold Rolling and Annealing Step

The wound hot-rolled steel sheet may be cold-rolled at a reduction ratio of 30 to 80% to obtain a cold-rolled steel sheet, and then the cold-rolled steel sheet may be annealed in a temperature range of 750 to 950° C.

When a cold reduction ratio is less than 30%, an accumulation energy for recrystallization during annealing may be insufficient and the recrystallization may not occur, and when the cold reduction ratio exceeds 80%, not only the rolling workability may become greatly unstable, but also power cost may be greatly increased, such that it may be preferable to perform cold-cooling at a temperature of 30 to 80%.

In addition, in annealing the cold-rolled cold rolling steel sheet (Full Hard material), when the temperature is less than 750° C., recrystallization may be difficult to occur, and when the temperature exceeds 950° C., an annealing temperature may be preferably be 750 to 950° C. due to an increase in process costs, or the like, due to high temperatures.

Cooling and Heat Treatment Step

After cooling the annealed cold-rolled steel sheet to a cooling termination temperature of Mf to Ms −90° C., the cooled cold-rolled steel sheet may be heat treated at Ms+100° C. or higher for 250 seconds or longer.

When the cooling termination temperature exceeds Ms−90° C., a large amount of retained austenite or a large amount of secondary martensite may be formed. When a large amount of retained austenite are formed, the stability of the retained austenite may be lowered, which may lead to a high transformed martensite area ratio at the time of transformation, which may cause the yield ratio to be deteriorated. When a large amount of secondary martensite are formed, an amount of mobile dislocation in the steel may be increased, such that the yield strength may be reduced and the yield ratio may be lowered.

On the other hand, the cooling termination temperature is less than $M_f$, an entire structure may be composed of fresh martensite, which may be easy to secure high strength, but may not secure elongation.

In addition, the reason which the heat treatment temperature should be $M_s$+100° C. or higher may be to smoothly diffuse austenite stabilization elements such as C, Mn, and the like to secure the stability of the retained austenite to obtain high yield strength and yield ratio. In this case, an upper limit of the heat treatment temperature is not particularly limited, when the upper limit thereof exceeds 500° C., the carbide may be easily precipitated and the stability of the austenite may not be secured, such that the upper limit may be 500° C.

In this case, the Ms temperature may be obtained by the following Relational Expression 1.

As described above, the Ms temperature may be a very important condition among the manufacturing conditions of the present disclosure. However, when the known Ms temperature is applied as it is, a large error may occur, and thus it is preferable to be obtained by the following Relational Expression 1 designed in consideration of the alloy composition of the present disclosure.

$$Ms=547.6-596.9C-27.4Mn-13.1Si-17.7Cr+8Al \quad \text{Relational Expression 1}$$

However, in the above Relational Expression 1, each element symbol may be a value representing a content of each element in weight %, and an unit of $M_s$ may be ° C. When the element is not included, it was calculated as 0.

Meanwhile, a step of immersing the heat treated cold-rolled steel sheet after the heat treating step immersed into a zinc plating bath to form a hot-dip galvanized layer may be further included.

In addition, a step of forming an alloyed hot-dip galvanized layer by performing an alloying heat treatment on the cold-rolled steel sheet on which the hot-dip galvanized layer is formed may be further included.

Mode for Invention

Hereinafter, the present disclosure will be described more specifically with reference to embodiments. It should be noted, however, the following embodiments are intended to illustrate the present disclosure in more detail, and not to limit the scope of the present disclosure. The scope of the present disclosure should be determined by the matters set forth in the appended claims and the matters reasonably inferred therefrom.

Steel having a component composition illustrated in the following Table 1 was melted under vacuum to prepare an ingot of 30 kg, and then maintained at a temperature of 1200° C. for 1 hour. Thereafter, hot-rolling were performed to finish finish-rolling at 900° C., and coiling operations after got-rolling were simulated by putting into a furnace already heated at a temperature of 600° C. for 1 hour, and then cooled in the furnace. Thereafter, cold-rolling was performed at a reduction ratio of 50%, and then annealed at 900° C., cooled to the cooling termination temperature shown in Table 2 below, and then reheated at a reheating temperature shown in Table 2 below during a reheating heat treatment time.

Thereafter, the yield strength (YS), the tensile strength (TS), the elongation (TE), the retained austenite fraction, the secondary martensite fraction and the yield ratio (YR) with respect to each specimen were measured and shown in Table 2 below.

In the case of microstructure, the portions except for the retained austenite and the secondary martensite were observed as ferrite, bainite and fresh martensite, and were not described separately.

In addition, the Ms temperature was calculated from the following Relational Expression 1 and illustrated in Table 1, and it was illustrated whether or not the Ms temperature is or less or excess Ms−90° C.

$$Ms=547.6-596.9C-27.4Mn-13.1Si-17.7Cr+8Al \quad \text{Relational Expression 1:}$$

TABLE 1

| Steel | C | Si | Mn | Cr | P | S | Al | Nb | N | Ms (□) |
|---|---|---|---|---|---|---|---|---|---|---|
| Inventive Steel 1 | 0.41 | 1.32 | 3.76 | 0.91 | 0.01 | 0.003 | 0.04 | — | 0.004 | 163 |
| Inventive Steel 2 | 0.31 | 1.5 | 6.25 | — | 0.01 | 0.003 | 2 | — | 0.004 | 183 |
| Inventive Steel 3 | 0.4 | 0.024 | 4.13 | | 0.01 | 0.005 | 1 | — | 0.004 | 200 |
| Inventive Steel 4 | 0.4 | 0.015 | 4.17 | 1.44 | 0.01 | 0.003 | 1.04 | — | 0.004 | 174 |
| Inventive Steel 5 | 0.4 | 0.24 | 4.18 | — | 0.01 | 0.003 | 1.08 | 0.5 | 0.004 | 196 |
| Comparative Steel 1 | 0.15 | 1.5 | 2.85 | — | 0.008 | 0.004 | — | — | 0.003 | 358 |
| Comparative Steel 2 | 0.24 | 1.5 | 2.9 | — | 0.007 | 0.003 | — | — | 0.005 | 302 |
| Comparative Steel 3 | 0.21 | 1 | 2.95 | — | 0.009 | 0.006 | — | — | 0.003 | 325 |
| Comparative Steel 4 | 0.18 | 1.5 | 3.4 | — | 0.01 | 0.004 | — | — | 0.004 | 324 |

In table 1, the unit of the content of each element may be % by weight.

TABLE 2

| Steel | Division | Cooling termination temperature (° C.) | Ms-90° C. | Reheating temperature (° C.) | Reheating heat treatment time (s) | YS (MPa) | TS (MPa) | TE (%) | YR | Retained austenite (area %) | Secondary martensite (area %) |
|---|---|---|---|---|---|---|---|---|---|---|---|
| Inventive Steel1 | Inventive Example 1 | 50 | Or less | 450 | 300 | 1446 | 1745 | 15 | 0.829 | 20 | 0 |
| | Inventive Example 2 | 70 | Or less | 450 | 300 | 1385 | 1769 | 14 | 0.783 | 25 | 0 |
| | Comparative Example 1 | 110 | Excess | 450 | 300 | 1077 | 1771 | 16 | 0.608 | 37 | 0 |
| Inventive Steel 2 | Inventive Example 3 | 40 | Or less | 450 | 300 | 1504 | 1626 | 10 | 0.925 | 18 | 0 |
| | Inventive Example 4 | 60 | Or less | 450 | 300 | 1474 | 1572 | 12 | 0.938 | 19 | 0 |
| | Comparative Example 2 | 120 | Excess | 450 | 300 | 665 | 1569 | 21 | 0.424 | 33 | 0 |
| Inventive Steel 3 | Inventive Example 5 | 50 | Or less | 400 | 430 | 1342 | 1512 | 8 | 0.887 | 17 | 0 |
| | Inventive Example 6 | 100 | Or less | 400 | 430 | 1260 | 1462 | 10 | 0.862 | 20 | 0 |
| | Comparative Example 3 | 150 | Excess | 400 | 430 | 837 | 1503 | 12 | 0.557 | 25 | 5.2 |
| Inventive Steel 4 | Inventive Example 7 | 50 | Or less | 400 | 430 | 1296 | 1468 | 12 | 0.883 | 21 | 0 |
| | Inventive Example 8 | 100 | Or less | 400 | 430 | 1170 | 1453 | 14 | 0.805 | 25 | 0 |
| | Comparative Example 4 | 150 | Excess | 400 | 430 | 780 | 1575 | 5 | 0.495 | 30 | 5.4 |
| Inventive Steel 5 | Inventive Example 9 | 50 | Or less | 400 | 430 | 1413 | 1505 | 11 | 0.939 | 16 | 0 |
| | Inventive Example 10 | 100 | Or less | 400 | 430 | 1271 | 1419 | 12 | 0.895 | 18 | 0 |
| | Comparative Example 5 | 150 | Excess | 400 | 430 | 837 | 1503 | 7 | 0.557 | 22 | 7.4 |
| Comparative Steel 1 | Comparative Example 6 | 220 | Or less | 460 | 400 | 991 | 1146 | 16 | 0.865 | 10 | — |
| | Comparative Example 7 | 260 | Or less | 460 | 400 | 973 | 1145 | 15 | 0.850 | 12 | — |
| | Comparative Example 8 | 300 | Excess | 460 | 400 | 922 | 1153 | 15 | 0.800 | 14 | — |
| | Comparative Example 9 | 340 | Excess | 460 | 400 | 644 | 1160 | 15 | 0.556 | 5 | — |
| Comparative Steel 2 | Comparative Example 10 | 230 | Excess | 460 | 400 | 577 | 1393 | 13 | 0.414 | 16 | — |
| | Comparative Example 11 | 270 | Excess | 460 | 400 | 721 | 1550 | 10 | 0.465 | 18 | — |
| | Comparative Example 12 | 300 | Excess | 460 | 400 | 746 | 1548 | 9 | 0.482 | 20 | — |
| | Comparative Example 13 | 330 | Excess | 460 | 400 | 766 | 1573 | 6 | 0.487 | 10 | — |
| Comparative Steel 3 | Comparative Example 14 | 230 | Or less | 460 | 400 | 714 | 1492 | 9 | 0.478 | 12 | — |
| | Comparative Example 15 | 270 | Excess | 460 | 400 | 726 | 1496 | 9 | 0.485 | 16 | — |
| | Comparative Example 16 | 300 | Excess | 460 | 400 | 696 | 1431 | 10 | 0.486 | 19 | — |
| | Comparative Example 17 | 330 | Excess | 460 | 400 | 740 | 1513 | 10 | 0.489 | 8 | — |

TABLE 2-continued

| Steel | Division | Cooling termination temperature (° C.) | Ms-90° C. | Reheating temperature (° C.) | Reheating heat treatment time (s) | YS (MPa) | TS (MPa) | TE (%) | YR | Retained austenite (area %) | Secondary martensite (area %) |
|---|---|---|---|---|---|---|---|---|---|---|---|
| Comparative Steel 4 | Comparative Example 18 | 230 | Or less | 460 | 400 | 1127 | 1250 | 15 | 0.902 | 9 | — |
| | Comparative Example 19 | 270 | Excess | 460 | 400 | 890 | 1282 | 13 | 0.694 | 12 | — |
| | Comparative Example 20 | 300 | Excess | 460 | 400 | 675 | 1409 | 10 | 0.479 | 17 | — |
| | Comparative Example 21 | 330 | Excess | 460 | 400 | 750 | 1452 | 11 | 0.517 | 14 | — |

As illustrated in Table 2, Inventive Examples satisfying the alloy composition and the manufacturing method of the present disclosure were able to secure a yield strength of 1000 MPa or more, a tensile strength of 1300 MPa or more, and a yield ratio of 0.7 or more.

In the case of Comparative Examples 1 to 2, in which the Inventive Steel was used, but the cooling termination temperature exceeds Ms−90° C., although the reheating heat treatment temperature and time were satisfied, the C diffusion to the austenite was not sufficient and the stability of the retained austenite could not be sufficiently secured, such that the yield ratio became 0.7 or less.

In addition, in the case of Comparative Examples 3 to 5 in which Inventive Steel was used, but the cooling termination temperature exceeds Ms−90° C. and the secondary martensite was transformed, an amount of mobile dislocation in the steel was increased, such that the yield ratio became 0.7 or less. FIG. 2 is a graph illustrating the transformation of the secondary martensite during final cooling for each cooling termination temperature of Inventive Steels 3 and 5, and it can be confirmed that the secondary martensite transformation occurs at a cooling termination temperature of 150° C. or higher.

In the case of Comparative Examples 6 to 17 using Comparative Steels 1 to 3 in which an amount of C is less than 0.3%, and an amount of Mn is less than 3%, the yield strength, the tensile strength, and the yield ratio were not satisfied regardless of whether the cooling termination temperature is not satisfied or not.

Meanwhile, in the case of Comparative Examples 18 to 21 using the Comparative Steel 4 in which the amount of C is less than 0.3%, when the cooling termination temperature is Ms−90° C. or less, the yield strength was 1000 MPa or more, such that the yield ratio was satisfied, but it did not satisfy 1300 MPa in terms of the tensile strength.

While exemplary embodiments have been illustrated and described above, it will be apparent to those skilled in the art that deformations and variations could be made without departing from the scope of the present disclosure as defined by the appended claims.

The invention claimed is:

1. An ultrahigh-strength steel sheet having an excellent yield ratio comprising:

0.3 to 0.5 wt % of carbon (C);

0.024 wt % or less of silicon (Si)(excluding 0%);

3.0 to 6.5 wt % of manganese (Mn);

0.02 wt % or less of phosphorus (P);

0.01 wt % or less of sulfur (S);

0.01 to 3.0 wt % of aluminum (Al);

0.02 wt % or less of nitrogen(N)(excluding 0%);

a remainder of iron (Fe); and other unavoidable impurities, wherein a microstructure comprises:

5 to 30% of retained austenite by area fraction,

5% or less of non-tempered martensite by area fraction, ferrite, and bainite, where a sum of the ferrite and the bainite is 20% or less by area fraction.

2. The ultrahigh-strength steel sheet having an excellent yield ratio of claim 1, wherein the steel sheet further comprises one or more of 1.5 wt % or less of chromium (Cr)(excluding 0%),0.005 to 0.5 wt % of titanium(Ti),0.005 to 0.5 wt % of niobium (Nb), 0.005 to 0.5 wt % of vanadium (V), and 0.05 to 0.3 wt % of molybdenum (Mo).

3. The ultrahigh-strength steel sheet having an excellent yield ratio of claim 1, wherein the steel sheet has a yield strength of 1000 MPa or more, a tensile strength of 1300 MPa or more, and a yield ratio of 0.7 or more.

4. The ultrahigh-strength steel sheet having an excellent yield ratio of claim 1, wherein the steel sheet has a hot-dip galvanized layer or an alloyed hot-dip galvanized layer formed on a surface of the steel sheet.

5. The ultrahigh-strength steel sheet having an excellent yield ratio of claim 1, comprising 6.25 to 6.5 wt % of manganese (Mn).

6. The ultrahigh-strength steel sheet having an excellent yield ratio of claim 1, wherein Si+Al is 1.32 wt %.

7. The ultrahigh-strength steel sheet having an excellent yield ratio of claim 1, wherein Si+Al is 1.32 wt % or less.

* * * * *